United States Patent [19]

Full

[11] 4,151,520

[45] Apr. 24, 1979

[54] PORTABLE SELF-CONTAINED ALARM WITH REMOTE TRIGGERING CAPABILITY

[76] Inventor: Elliott D. Full, 1820 Rochester, Iowa City, Iowa 52240

[21] Appl. No.: 818,588

[22] Filed: Jul. 25, 1977

[51] Int. Cl.[2] ..... G08B 13/08; G08B 15/00

[52] U.S. Cl. ..... 340/528; 340/546; 340/574

[58] Field of Search ..... 340/283, 420, 274 R, 340/528, 516, 574, 545, 546

[56] References Cited

U.S. PATENT DOCUMENTS

| | | | |
|---|---|---|---|
| 2,228,120 | 1/1941 | Koehler | 340/274 R |
| 3,683,346 | 8/1972 | Horton | 340/528 |
| 3,771,154 | 11/1973 | Takei | 340/274 R |
| 3,803,576 | 4/1974 | Dobrzanski et al. | 340/528 |
| 4,030,087 | 6/1977 | Ritchie et al. | 340/516 |

*Primary Examiner*—Glen R. Swann, III

*Attorney, Agent, or Firm*—Zarley, McKee, Thomte, Voorhees & Sease

[57] ABSTRACT

An alarm device is provided comprising a portable housing having an audio alarm positioned therein and a battery powered electronic circuit for activating the alarm. The circuit comprises a battery, an arming switch, a triggering switch, an audio alarm, and a latching circuit and oscillator circuit utilizing an integrated circuit therein. The circuit also includes a means for connecting auxiliary devices thereto and a means for coupling an AC adapter. A magnetically operated reed switch and a mechanically operated pull switch comprise the normally open triggering switch. The triggering switch also contains means for adapting any activator wired normally open to the triggering switch. The oscillator circuit drives the audio alarm whenever any of the triggering switches are closed and the latching circuit maintains the oscillator in an operating mode.

11 Claims, 5 Drawing Figures

PORTABLE SELF-CONTAINED ALARM WITH REMOTE TRIGGERING CAPABILITY

BACKGROUND OF THE INVENTION

This invention relates to an alarm device and more particularly to a highly versatile portable alarm device. Many alarm devices have been provided which are designed to be activated upon the unauthorized opening of doors, windows or even purse snatching. The presently available alarm devices are not very versatile, portable or convenient to use and do not provide for integration with the wide variety of activators available such as heat sensors or vibration switches. Prior alarm devices do not provide the versatility combined with compactness.

SUMMARY OF THE INVENTION

A portable self-contained alarm device is disclosed comprising a housing, an audio alarm, a battery, and a battery powered electronic circuit for activating the audio alarm. Means are also provided for coupling an AC adapter and thereby powering the circuit by alternating current. The circuit comprises a battery, an arming switch, a triggering switch means, an audio alarm and a latching circuit and oscillator circuit utilizing an integrated circuit therein. The normally open triggering switch means comprises a magnetically operated reed switch, a mechanically operated pull switch for attachment to a lanyard and the like, and means for attaching any remote activator normally wired in an open mode. The oscillator circuit powers the audio alarm when any of the triggering switch means are closed, and the latching circuit maintains the oscillator in an operational mode to power the audio alarm until the arm switch is opened.

It is a principal object of the invention to provide an improved alarm device. A further object of the invention is to provide an alarm device including a circuit means adapted to actuate an audio alarm wherein the audio alarm remains activated until a reset switch is opened.

A further object of the invention is to provide an alarm device which may be activated by either a magnetically operated reed switch, a trip string, or any remote activator or detector normally wired open.

A still further object of the invention is to provide an alarm device which is totally self-contained, which may be carried on the person, and easily activated when desired.

A still further object of the invention is to provide an alarm device which is highly versatile in use and in combination with other detection and alarm devices.

A still further object of the invention is to provide an alarm device which provides a time delay between the closing of the arming switch and the activation of the alarm by the triggering switch.

A still further object of the invention is to provide an alarm device that produces a pulsating sound.

A still further object of the invention is to provide a portable alarm device which is economical to manufacture, economical to maintain, durable in use and refined in appearance.

DESCRIPTION OF THE PREFERRED EMBODIMENT

Figure 1:
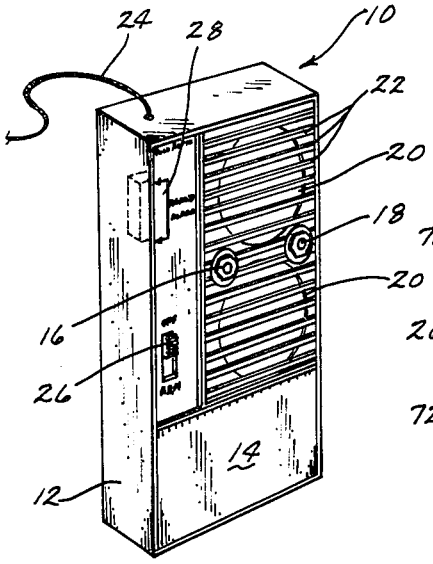
FIG. 1 is a perspective view of the alarm device of this invention.

The alarm device of this invention is referred to generally by the reference numeral 10 and generally comprises a portable housing 12. The front face 14 of housing 12 contains a tiny jack connector 16 for connection to an external AC adapter (not shown) and a micro-jack 18 for connection to a remote activator (not shown), as shown in FIG. 1. Audio horns 20 are located behind the grating 22 of front face 14. Lanyard 24 activates the alarm circuit by the pulling thereof. Numeral 28 designates the general operational area on front face 14 of the magnetic triggering switch (not shown). Arming switch 26 is a two position switch which is the off position disconnects the batteries (not shown) from the electrical circuit and in the arm position sets the circuit in an operational mode to be activated by a triggering device as explained in more detail below.

Figure 5:
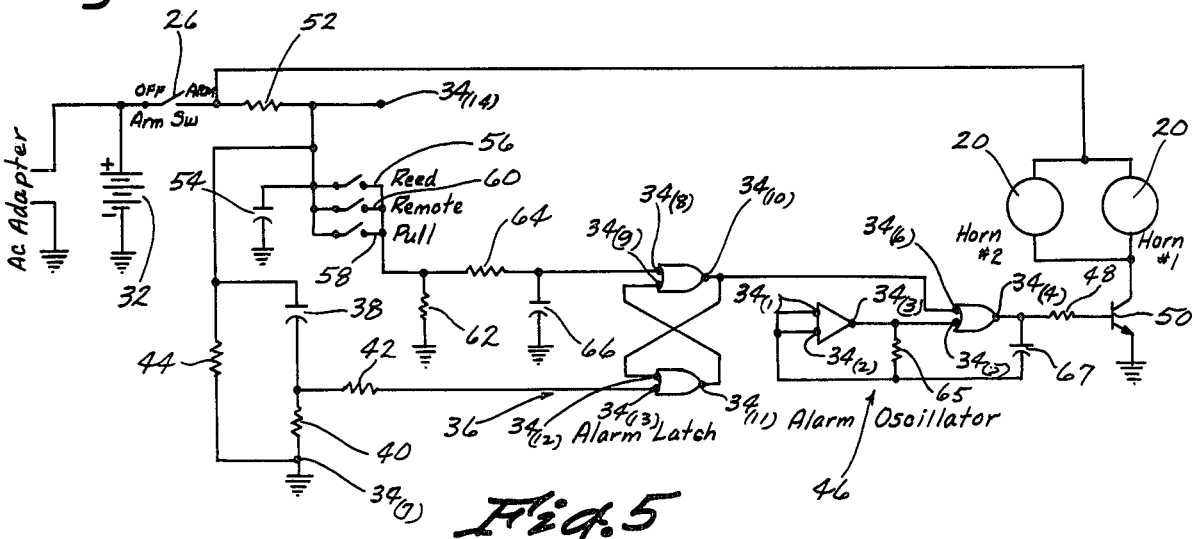
FIG. 5 is a schematic of the circuitry of the invention.

The circuitry of the alarm device 10 is shown in schematic form in FIG. 5. In FIG. 5, the numeral 32 refers to a 9 volt battery source preferably comprised of six AA penlight cells. Arming switch 26 is a two position switch electrically connecting battery 32 to the remaining circuitry when in a closed position. For the purposes of explanation and clarity, the respective pins of integrated circuit 34 will be designated by the numeral 34 with a subscript indicating the particular pin of integrated circuit 34, e.g., $34_1$ designates pin 1 of integrated circuit 34. Integrated circuit 34 is preferably MC14001 (CP 7603) manufactured by Motorola, but any integrated circuit exhibiting similar characteristics and similar functions may be utilized.

Moving arming switch 26 from the "off" to the "arm" position momentarily applies a 6 to 9 volt reset pulse to pin $34_{13}$ of latching circuit 36. Duration of this pulse is set by the capacitor 38 and resistor 40, and should be approximately 8 seconds in duration. Resistor 42 is input protection for pin $34_{13}$ and resistor 44 is a discharge path for capacitor 38 when the arming switch 26 is turned "off". The reset pulse forces pin $34_{10}$ of latching circuit 36 to be 6 to 9 volts, which thereby disables the alarm oscillator at pin $34_6$ of the integrated circuit 34 and thereby forces pin $34_4$ of integrated circuit 34 to be at 0 volts. Zero volts at resistor 48 causes the collector of transistor 50 to be at 6 to 9 volts and therefore the horns 20 have the same potential at both terminals which keeps them turned off. Resistor 52 and capacitor 54 serve as filtering and transient protection for the latching and oscillating circuits. In this arm position, very little battery power is used to maintain the circuit in a ready condition.

Magnetic reed switch 56 is a magnetically operated, normally open triggering switch and is wired in parallel with the normally open pull switch 58. Remote switch 60 is also wired in parallel with reed switch 56 and pull switch 58 and represents a remote, normally open activating device. Resistor 62 is a pull down resistor, Resistor 64 is a protection resistor and capacitor 66 is the noise filter capacitor for latching circuit 36 input, pin $34_8$. Resistor 65 is connected to pin $34_3$ and $34_2$, and capacitor 67 is connected to pin $34_4$ and $34_2$. When a 6 to 9 volt pulse occurs at pin $34_8$ of latching circuit 36, by closing either reed switch 56, remote switch 60 or pull switch 58, the pin $34_{10}$ of latching circuit 36 becomes zero volts and therefore pin $34_6$ of alarm oscillator 46 also becomes zero volts. This enables alarm oscillator 46 to apply a square wave voltage which varies from 6 to 9 volts to zero volts at pin $34_4$. The duty cycle of the square wave is approximately 50% and the frequency is approximately 2 Hertz. When the voltage at pin $34_4$ is 6 to 9 volts, the collector voltage of transistor 50 is zero volts which therefore results in 6 to 9 volts applied to the horns 20. The horns 20 turn off again when the voltage at pin $34_4$ becomes zero, creating a pulsating alarm.

If the pulse at pin $34_8$ of latching circuit 36 occurs during the 8 second turn on delay, the horn pulsing will be momentary. If the pulse at pin $34_8$ occurs after the 8 second turn on delay, the alarm condition will be latched in, and the horn pulsing will last until arming switch 26 is turned "off" or until batteries 32 run down.

Figure 2:
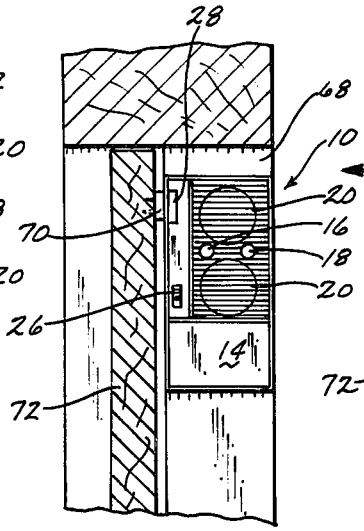
FIG. 2 is a front elevational view of the device mounted to a doorway jamb.
Figure 3:
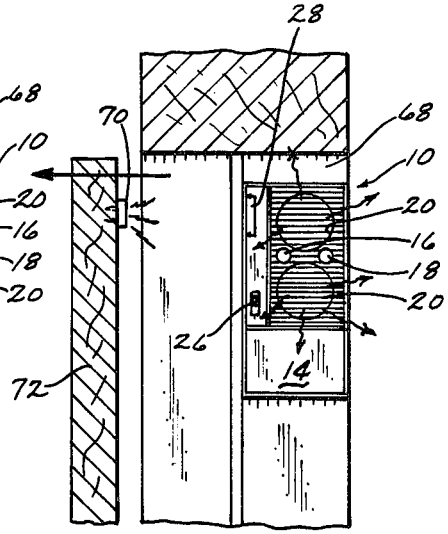
FIG. 3 is a view similar to FIG. 2 with the door open.
Figure 4:
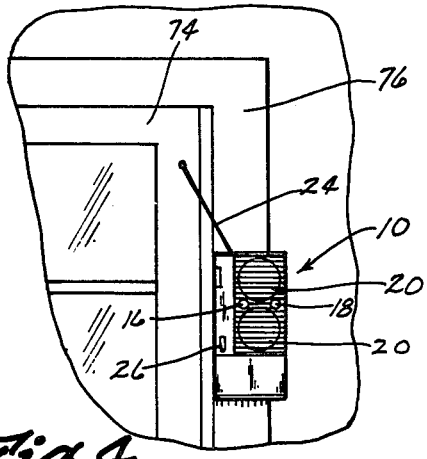
FIG. 4 is a partial front elevational view of the device mounted to a window jamb.

Alarm device 10 may be installed and utilized in a variety of ways. Alarm device 10 may be mounted on a door jamb 68 with a magnet 70 mounted on the inside edge of the door 72 adjacent the magnetic alarm area 28 of alarm device 10 as shown in FIG. 2. After activating arming switch 26, there is allowed eight seconds to leave through the door before the alarm will sound. After the eight-second delay, any subsequent opening of the door will move the magnet 70 towards, then away from, the magnetic alarm area 28, (FIG. 3) pulsing reed switch 56 and thereby activating horns 20. Thus, an easily installed, simply operating alarm device is disclosed. Pull switch 58 is attached to lanyard 24 and may be attached to a purse or may be pulled in an emergency to activate horns 20. As shown in FIG. 4, alarm device 10 may be mounted to window jamb 76 with lanyard 24 attached to window 74. The movement of window 74 upon opening will close pull switch 58 activating horns 20. To protect against the removal of any object, the lanyard 24 may be attached to that object and will activate horns 20 upon the pulling of lanyard 24 to close pull switch 58. Sophisticated alarms such as radars, electronic eyes, smoke detectors, ultrasonics, vibration detectors, etc. when normally wired open can be connected to alarm device 10 through microjack 18 for versatile operation.

Thus, it can be seen that a novel alarm device has been provided which is extremely versatile and which accomplishes at least all of its stated objectives.

What is claimed is:

1. A portable alarm device comprising, a portable housing, a battery means within said housing, an audio alarm within said housing, and an electronic circuit means within said housing connecting said battery means to said alarm, said electronic circuit means comprising an oscillator circuit means to drive said alarm, a latching circuit means to hold said oscillator circuit means in an operating mode after activation, said oscillator circuit means being electrically connected to said latching circuit means and said alarm, a first triggering switch means to activate said oscillator circuit means and said alarm, and a second switch means electrically connected to positions with said first triggering switch means being electrically connected to said latching circuit means and said second switch means, said first position of said second switch means being a closed position to place said electronic circuit means in a ready, armed mode so that activation of said triggering switch means activates said oscillator circuit means and said alarm, said latching circuit means being disabled for a predetermined time period after said second switch means assumes said first position so that activation of said triggering switch means during said predetermined time period momentarily activates said oscillator circuit means and said alarm in an unlatched condition and the activation of said triggering switch means subsequent to said predetermined time period activates said latching circuit means, said oscillator circuit means and said alarm in a latched condition, said second position of said second switch means being an open position to place said electronic circuit means in an off, unarmed mode.

2. The device of claim 1 wherein said latching circuit means and said oscillator circuit means comprise an integrated circuit component electrically connected in series with a transistor.

3. The device of claim 2 wherein said first triggering switch means comprises a normally open, magnetically operated, reed switch electrically connected in parallel to a normally open, mechanically operated, pull switch and a jack means connected in parallel to said reed switch and said pull switch for electrical connection of a remote, normally open, switch in an auxiliary device for actuation of said audio alarm by said auxiliary device.

4. The device of claim 3 wherein a second jack means is connected to said second switch means such that an AC adapter may be connected to said electronic circuit means for use of alternating current.

5. The device of claim 4 wherein a lanyard is connected at one end to said pull switch and extends outwardly from said housing.

6. The device of claim 1 wherein said latching circuit means and said oscillator circuit means maintain a zero potential voltage across said audio alarm when said first triggering switch means is in an open position and said second two position switch means is in the first, closed position.

7. The device of claim 6 wherein said latching circuit means and said oscillator circuit means maintain a pulsating driving voltage across said audio alarm to activate said alarm when said first triggering switch means is in a closed position and said second switch means is in a first closed position.

8. The device of claim 1 wherein said audio alarm sounds in a pulsating manner when activated by said oscillator circuit means and said latching circuit means.

9. The device of claim 1 wherein said first triggering switch means is a normally open switch means.

10. The device of claim 1 wherein said second position of said second switch means disconnects said battery means from said electronic circuit means.

11. The device of claim 1 wherein activation of said first triggering switch means instantaneously activates said oscillator circuit means and said alarm.

* * * * *